US009180658B2

(12) United States Patent
Kanasugi et al.

(10) Patent No.: US 9,180,658 B2
(45) Date of Patent: Nov. 10, 2015

(54) IMAGE RECORDING METHOD

(71) Applicant: CANON KABUSHIKI KAISHA, Tokyo (JP)

(72) Inventors: Yuichiro Kanasugi, Tokyo (JP); Mitsutoshi Noguchi, Kawaguchi (JP); Takashi Imai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/302,235

(22) Filed: Jun. 11, 2014

(65) Prior Publication Data

US 2014/0368593 A1 Dec. 18, 2014

(30) Foreign Application Priority Data

Jun. 14, 2013 (JP) ..... 2013-125709

(51) Int. Cl.

| | |
|---|---|
| ***B41J 2/01*** | (2006.01) |
| ***B41J 2/005*** | (2006.01) |
| ***B41M 5/00*** | (2006.01) |
| ***B41M 5/025*** | (2006.01) |

(52) U.S. Cl.

CPC ..... *B41J 2/0057* (2013.01); *B41M 5/0023* (2013.01); *B41M 5/0256* (2013.01); *B41J 2002/012* (2013.01)

(58) Field of Classification Search

CPC ..... B41J 2/0057; B41J 2002/012

See application file for complete search history.

(56) References Cited

U.S. PATENT DOCUMENTS 9,039,159 B2 * 5/2015 Imai et al. ..... 347/100

FOREIGN PATENT DOCUMENTS

JP 7-32721 A 2/1995
WO WO 2012014427 A1 * 2/2012

* cited by examiner

*Primary Examiner* — Lisa M Solomon

(74) *Attorney, Agent, or Firm* — Canon U.S.A. Inc., IP Division

(57) ABSTRACT

An image recording method includes an intermediate image-forming step of forming an intermediate image by applying an ink to an intermediate transfer body, a temperature adjusting step, and a transfer step of transferring the intermediate image onto a recording medium, in this order. The ink includes polymer particles and a surfactant which is at least one selected from a compound represented by general formula (1) and a compound represented by general formula (2). In the temperature adjusting step, a temperature of the intermediate image is adjusted to a temperature higher than or equal to a cloud point of the surfactant.

17 Claims, 1 Drawing Sheet

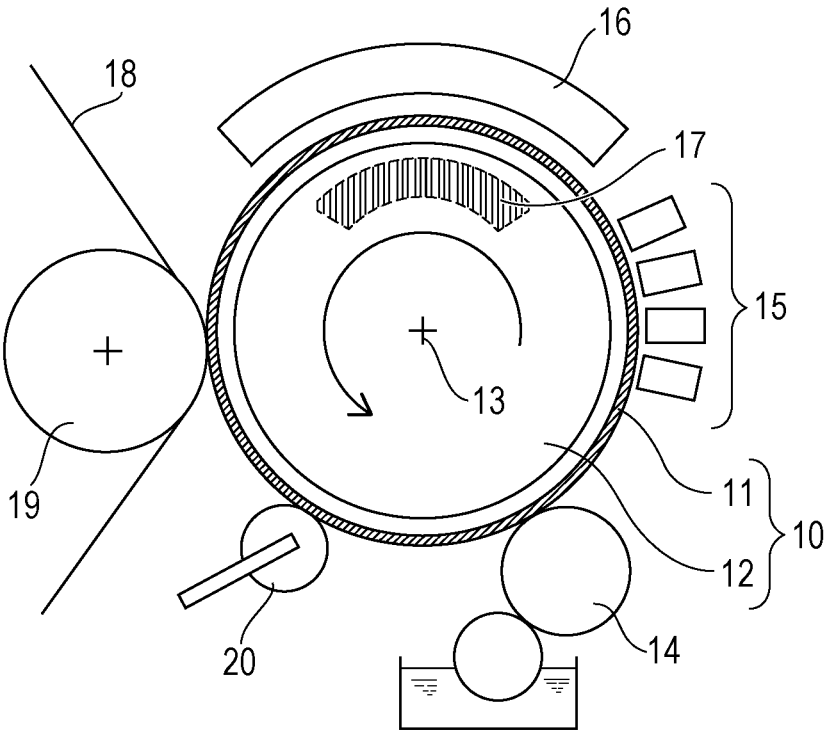
16
18
17
15
13
11
10
12
19
20
14

IMAGE RECORDING METHOD

BACKGROUND OF THE INVENTION

1. Field of the Invention

The present invention relates to an image recording method.

2. Description of the Related Art

There has been known an image recording method with which ink is applied to an intermediate transfer body to record an intermediate image and the intermediate image is transferred onto a recording medium (hereinafter, this method may also be referred to as "intermediate transfer-type image recording method"). In recent years, with the increasing demand for high-speed recording, intermediate transfer-type image recording methods with which high-quality images are obtained even at a high transfer speed have been studied. In intermediate transfer-type image recording methods, the efficiency of transferring intermediate images formed on intermediate transfer bodies onto recording media significantly affects the quality of images obtained. Typically, in order to improve the transfer efficiency, an approach of using an ink that contains polymer particles has been studied (refer to Japanese Patent Laid-Open No. 7-32721). Japanese Patent Laid-Open No. 7-32721 discloses that the transfer efficiency is improved by using an ink that contains polymer particles having a minimum film-forming temperature of 50° C. or higher and heating the ink to a temperature equal to or higher than the minimum film-forming temperature during transfer.

SUMMARY OF THE INVENTION

An image recording method according to a first embodiment of the present invention includes an intermediate image-forming step of forming an intermediate image by applying an ink to an intermediate transfer body, a temperature adjusting step, and a transfer step of transferring the intermediate image onto a recording medium, in this order. The ink contains polymer particles and a surfactant which is at least one selected from a compound represented by general formula (1) below and a compound represented by general formula (2) below. In the temperature adjusting step, a temperature of the intermediate image is adjusted to a temperature higher than or equal to a cloud point of the surfactant.

An image recording method according to a second embodiment of the present invention includes a liquid composition-applying step of applying a liquid composition containing a surfactant to an intermediate transfer body, an intermediate image-forming step of forming an intermediate image by applying an ink containing polymer particles to the intermediate transfer body to which the liquid composition has been applied, a temperature adjusting step, and a transfer step of transferring the intermediate image onto a recording medium, in this order. The surfactant is at least one selected from a compound represented by general formula (1) below and a compound represented by general formula (2) below. In the temperature adjusting step, a temperature of the intermediate image is adjusted to a temperature higher than or equal to a cloud point of the surfactant.

General formula (1)

$$R^1\text{-}(CH_2\text{-}CH_2\text{-}O)_l\text{-}R^2\text{-}(CH_2\text{-}\overset{\overset{CH_3}{|}}{CH}\text{-}O)_m\text{-}R^3\text{-}(CH_2\text{-}CH_2\text{-}O)_n\text{-}R^4$$

In the general formula (1), $R^1$ and $R^4$ each independently represent a hydrogen atom or an organic group, $R^2$ and $R^3$ each independently represent a single bond or an organic group, l and n each independently represent 0 or more, l+n represents 2 or more and 300 or less, and m represents 1 or more and 70 or less.

General formula (2)

$$R^5\text{-}(CH_2\text{-}\overset{\overset{CH_3}{|}}{CH}\text{-}O)_p\text{-}R^6\text{-}(CH_2\text{-}CH_2\text{-}O)_q\text{-}R^7\text{-}(CH_2\text{-}\overset{\overset{CH_3}{|}}{CH}\text{-}O)_r\text{-}R^8$$

In the general formula (2), $R^5$ and $R^8$ each independently represent a hydrogen atom or an organic group, $R^6$ and $R^7$ each independently represent a single bond or an organic group, p and r each independently represent 0 or more, p+r represents 2 or more and 70 or less, and q represents 1 or more and 300 or less.

Further features of the present invention will become apparent from the following description of exemplary embodiments with reference to the attached drawing.

BRIEF DESCRIPTION OF THE DRAWING

FIGURE is a schematic view illustrating an example of a structure of a recording apparatus used in an embodiment of the present invention.

DESCRIPTION OF THE EMBODIMENTS

According to the studies conducted by the inventors of the present invention, when recording is performed at a high transfer speed using the ink containing polymer particles and described in Japanese Patent Laid-Open No. 7-32721, a high-quality image is not formed.

Accordingly, aspects of the present invention provide an image recording method with which a high-quality image is formed with a high transfer efficiency even when recording is performed at a high transfer speed.

The present invention will now be described in detail using embodiments. First, the inventors of the present invention have studied the properties desirable for achieving high transfer efficiency in intermediate transfer-type image recording methods. As a result, it has been found that it is important to have both of the following properties: (i) that the intermediate image is robust and (ii) that the adhesion of the intermediate image to a recording medium is high. By satisfying the property (i), occurrence of partial transfer of the intermediate image during the transfer from the intermediate transfer body to the recording medium is suppressed. By satisfying the property (ii), transfer of the intermediate image onto the recording medium is facilitated.

The inventors have conducted studies on conditions required to satisfy the properties (i) and (ii) and finally have found a structure according to an embodiment of the present invention. Specifically, the intermediate image includes polymer particles and a surfactant which is at least one selected from a surfactant represented by general formula (1) below and a surfactant represented by general formula (2) below (hereafter, may also be referred to as "surfactants represented by general formulae (1) and/or (2)") and furthermore the image recording method includes a step of adjusting the temperature of the intermediate image to a temperature higher than or equal to the cloud point of the surfactant before transfer of the intermediate image.

General formula (1)

$$R^1\text{-}(CH_2\text{-}CH_2\text{-}O)_l\text{-}R^2\text{-}(CH_2\text{-}\overset{\overset{CH_3}{|}}{CH}\text{-}O)_m\text{-}R^3\text{-}(CH_2\text{-}CH_2\text{-}O)_n\text{-}R^4$$

In the general formula (1), $R^1$ and $R^4$ each independently represent a hydrogen atom or an organic group, $R^2$ and $R^3$ each independently represent a single bond or an organic group, l and n each independently represent 0 or more, l+n represents 2 or more and 300 or less, and m represents 1 or more and 70 or less.

General formula (2)

$$R^5\text{-}(CH_2\text{-}\overset{\overset{CH_3}{|}}{CH}\text{-}O)_p\text{-}R^6\text{-}(CH_2\text{-}CH_2\text{-}O)_q\text{-}R^7\text{-}(CH_2\text{-}\overset{\overset{CH_3}{|}}{CH}\text{-}O)_r\text{-}R^8$$

In the general formula (2), $R^5$ and $R^8$ each independently represent a hydrogen atom or an organic group, $R^6$ and $R^7$ each independently represent a single bond or an organic group, p and r each independently represent 0 or more, p+r represents 2 or more and 70 or less, and q represents 1 or more and 300 or less.

The mechanism with which the advantageous effects according to aspects of the present invention are achieved by this structure will be described below.

The surfactants represented by the general formulae (1) and (2) above exhibit surface activity because they have an ethylene oxide structure ($CH_2CH_2O$) having high hydrophilicity and a propylene oxide structure ($CH_2CH(CH_2)O$) having low hydrophilicity. However, the structure of such surfactants is not a structure in which hydrophilicity or hydrophobicity is definitely present as in typical surfactants, and thus such surfactants have relatively low surface activity. Therefore, when the surfactants are present together with polymer particles, the surfactants tend to be dissolved in an aqueous medium in the intermediate image or adsorbed onto the polymer particles rather than being aligned at a gas-liquid interface. According to aspects of the present invention, by employing a step of adjusting the temperature of the intermediate image to a temperature higher than or equal to cloud points of the surfactants, the former surfactant that is dissolved in the aqueous medium in the intermediate image is precipitated. As described above, the precipitated surfactant also tends to be adsorbed onto the polymer particles. Therefore, in the intermediate image, many molecules of the surfactants represented by the general formulae (1) and/or (2) are adsorbed onto the surfaces of the polymer particles. Herein, the polymer particles contained in the intermediate image are attached to each other through the surfactants that have adsorbed onto the polymer particles, and thus the entire intermediate image becomes robust (the property (i)).

It has been also found that the adhesiveness generated when the polymer particles and the recording medium are brought into contact with each other is improved by satisfying the structure according to an embodiment of the present invention (the property (ii)). This may be because the surfactants represented by the general formulae (1) and/or (2) that have adsorbed onto the polymer particles have a high affinity for the recording medium and thus the polymer particles easily move to the recording medium side.

As described above, according to aspects of the present invention, the properties (i) and (ii) can be satisfied by incorporating the surfactants represented by the general formulae (1) and/or (2) into the intermediate image together with the polymer particles and also employing a step of adjusting the temperature of the intermediate image to a temperature higher than or equal to cloud points of the surfactants before transfer of the intermediate image. As a result, high transfer efficiency is achieved.

The synergistic effects of the components and the step are produced through the mechanisms described above, whereby the advantageous effects according to aspects of the present invention can be achieved.

According to aspects of the present invention, examples of the method for incorporating the surfactants represented by the general formulae (1) and/or (2) into the intermediate image together with the polymer particles include a method in which both the polymer particles and the surfactants represented by the general formulae (1) and/or (2) are contained in an ink (first embodiment) and a method in which the polymer particles are contained in an ink and the surfactants represented by the general formulae (1) and/or (2) are contained in a liquid composition different from the ink (second embodiment). Each of the embodiments will be described below in detail. Note that "(meth)acrylic acid" is hereafter referred to as "acrylic acid" and "methacrylic acid" and "(meth)acrylate" is hereafter referred to as "acrylate" and "methacrylate".

(1) First Embodiment

An image recording method according to a first embodiment of the present invention (hereafter may also be simply referred to as "first embodiment") includes an intermediate image-forming step of forming an intermediate image by applying, to an intermediate transfer body, an ink that contains polymer particles and a surfactant which is at least one selected from a compound represented by the general formula (1) and a compound represented by the general formula (2); a temperature adjusting step of adjusting a temperature of the intermediate image to a temperature higher than or equal to a cloud point of the surfactant; and a transfer step of transferring the intermediate image onto a recording medium.

FIGURE is a schematic view illustrating an example of an image recording apparatus used in the image recording method according to an embodiment of the present invention. In the image recording apparatus illustrated in FIGURE, an intermediate transfer body 10 includes a drum-shaped rotatable supporting member 12 and a top layer member 11 disposed on an outer peripheral surface of the supporting member 12. The intermediate transfer body 10 (supporting member 12) rotates about a rotation axis 13 in a direction indicated by an arrow (counterclockwise in the drawing). Components disposed around the intermediate transfer body 10 are configured to operate in synchronization with the rotation of the intermediate transfer body 10. When the image recording method includes a step of applying a liquid composition to the intermediate transfer body 10, the liquid composition may be applied to the intermediate transfer body 10 with an application roller 14 or the like. An ink is ejected from an inkjet recording head 15 and consequently an intermediate image, which is a mirror reflected image of an intended image, is formed on the intermediate transfer body 10. Subsequently, the temperature of the intermediate image formed on the intermediate transfer body 10 is adjusted to a desired temperature with a temperature-adjusting mechanism 17. Herein, a liquid in the intermediate image formed on the intermediate transfer body 10 may be removed with a liquid-removing mechanism 16. Subsequently, a recording medium 18 is brought into contact with the intermediate transfer body 10 using a pressure roller 19 to transfer the intermediate image onto the recording medium 18. A cleaning unit 20 may be disposed to perform a step of cleaning the surface of the intermediate transfer body 10. Each of the steps of the first embodiment will be described below in detail.

Intermediate Image-Forming Step

In the first embodiment, the intermediate image-forming step includes applying an ink to the intermediate transfer body. An inkjet method can be used as a method for applying an ink to the intermediate transfer body. In particular, a method in which an ink is ejected from an ejection orifice of a recording head by the action of thermal energy to the ink can be used.

For example, a line head or a serial head can be used as the inkjet recording head. In the line head, ink ejection orifices are arranged in a direction (axial direction in a drum shape) perpendicular to the rotational direction of the intermediate transfer body. The serial head is a head that performs recording by scanning the intermediate transfer body in a direction perpendicular to the rotational direction of the intermediate transfer body.

Intermediate Transfer Body

According to aspects of the present invention, the intermediate transfer body is a base which retains a liquid composition and an ink and on which an intermediate image is to be recorded. For example, the intermediate transfer body includes a supporting member that conveys a required force by handling the intermediate transfer body itself and a top layer member on which an intermediate image is to be recorded. Note that the supporting member and the top layer member may be integrally provided.

Examples of the shape of the intermediate transfer body include a sheet-like shape, a roller-like shape, a drum-like shape, a belt-like shape, and an endless web shape. The size of the intermediate transfer body can be suitably set in accordance with the size of a recording medium that can be recorded.

The supporting member of the intermediate transfer body is required to have a certain level of strength from the viewpoint of the conveyance accuracy and durability. The supporting member can be composed of, for example, a metal, a ceramic, or a resin. In particular, the supporting member can be composed of aluminum, iron, stainless steel, acetal resin, epoxy resin, polyimide, polyethylene, polyethylene terephthalate, nylon, polyurethane, silica ceramic, or alumina ceramic. When the supporting member is composed of such a material, high rigidity and dimensional accuracy can be achieved even when pressure is applied during transfer, and furthermore the inertia during operation is suppressed and the responsiveness for control can be improved. These materials can be used alone or in combination of two or more.

In the intermediate transfer body, an intermediate image is transferred onto a recording medium such as paper by applying pressure, and thus the top layer of the intermediate transfer body needs to have a certain level of elasticity. For example, when paper is used as a recording medium, the Duro A hardness (Durometer, type A hardness) of the top layer of the intermediate transfer body, which is in conformity with JIS K 6253, is preferably 10 degrees or more and 100 degrees or less and more preferably 20 degrees or more and 60 degrees or less. A top layer member constituting the top layer of the intermediate transfer body can be composed of, for example, a metal, a ceramic, or a resin. In particular, the top layer member can be composed of polybutadiene rubber, nitrile rubber, chloroprene rubber, silicone rubber, fluorocarbon rubber, fluorosilicone rubber, urethane rubber, styrene elastomer, olefin elastomer, vinyl chloride elastomer, ester elastomer, amide elastomer, polyether, polyester, polystyrene, polycarbonate, a siloxane compound, or a perfluorocarbon compound. The top layer member may be formed by stacking a plurality of materials. For example, the top layer member may be formed by stacking silicone rubber on an endless belt-shaped urethane rubber sheet, stacking silicone rubber on a polyethylene terephthalate film, or forming a film composed of a siloxane compound on a urethane rubber sheet.

The surface of the intermediate transfer body may be subjected to a surface treatment. Examples of the surface treatment include a flame treatment, a corona treatment, a plasma treatment, a polishing treatment, a roughening treatment, an active-energy-ray irradiation treatment, an ozone treatment, a surfactant treatment, and a silane coupling treatment. These treatments may be combined with each other.

From the viewpoint of suppressing the flow of an intermediate image on the intermediate transfer body, the arithmetic mean roughness of the surface of the intermediate transfer body, which is defined in JIS B 0601:2001, can be 0.01 μm or more and 3 μm or less. Furthermore, the contact angle of water on the surface of the intermediate transfer body is preferably 50 degrees or more and 110 degrees or less and more preferably 60 degrees or more and 100 degrees or less.

Ink

An ink used in the image recording method according to the first embodiment contains polymer particles and the surfactants represented by the general formulae (1) and/or (2). The polymer particles and the surfactants represented by the general formulae (1) and (2) will be described below in detail.

In the first embodiment, the content of the polymer particles in the ink is preferably 0.5% by mass or more and 40.0% by mass or less and more preferably 1.0% by mass or more and 30.0% by mass or less based on the total mass of the ink.

In the first embodiment, the content of the surfactants represented by the general formulae (1) and (2) in the ink is preferably 0.1% by mass or more and 30.0% by mass or less and more preferably 0.5% by mass or more and 10.0% by mass or less based on the total mass of the ink. If the content is less than 0.5% by mass, the surfactants do not sufficiently adsorb onto the surfaces of the polymer particles and thus an effect of improving the transfer efficiency is sometimes not sufficiently achieved. If the content is more than 10.0% by mass, the ejection stability of the ink is sometimes not sufficiently achieved. In aspects of the present invention, the expression "the content of the surfactants represented by the general formulae (1) and (2) in the ink" means the total content of at least one surfactant selected from a compound represented by general formula (1) and a compound represented by general formula (2).

In the first embodiment, the mass ratio of the content of the polymer particles in the ink to the content of the surfactants represented by the general formulae (1) and (2) in the ink can be 0.33 or more and 20 or less on the basis of the total mass of the ink.

In the first embodiment, the mass ratio of the content of the polymer particles in the ink to the content of a coloring material can be 0.1 or more and 30.0 or less on the basis of the total mass of the ink.

Liquid Composition-Applying Step

In the first embodiment, a liquid composition-applying step of applying a liquid composition to the intermediate transfer body may be performed prior to the intermediate image-forming step. Examples of a method for applying a liquid composition to the intermediate transfer body include coating methods such as roller coating, bar coating, and spray coating and inkjet methods. In particular, coating methods can be used.

Liquid Composition

According to aspects of the present invention, the liquid composition can contain a reacting agent that precipitates or aggregates components (e.g., coloring material and polymer) of the ink. The reacting agent will be described below in detail. Specific examples of the reacting agent include polyvalent metal ions and organic acids. The amount of the liquid composition applied can be 0.1 $g/m^2$ or more and 10.0 $g/m^2$ or less.

According to aspects of the present invention, the liquid composition can be colorless, milk white, or white so as not to affect an image recorded with the ink. Therefore, the ratio of the maximum absorbance to the minimum absorbance (maximum absorbance/minimum absorbance) in a visible wavelength range of 400 nm to 800 nm can be 1.0 or more and 2.0 or less. This means that there are substantially no absorption peaks in a visible wavelength range or the peak intensity is extremely low even if there are absorption peaks. Furthermore, in aspects of the present invention, the liquid composition desirably does not contain a coloring material. The absorbance can be measured with Double Beam Spectrophotometer U-2900 (manufactured by Hitachi High-Technologies Corporation) using an undiluted liquid composition. Herein, the absorbance may be measured using a diluted liquid composition. This is because the maximum absorbance and the minimum absorbance of the liquid composition are both proportional to the dilution factor, and thus the ratio of the maximum absorbance to the minimum absorbance (maximum absorbance/minimum absorbance) is not dependent on the dilution factor.

Temperature Adjusting Step

In the first embodiment, the temperature adjusting step is a step of adjusting the temperature of the intermediate image to a temperature higher than or equal to the cloud points of the surfactants represented by the general formulae (1) and/or (2) in the ink. In the present invention, "the temperature of the intermediate image in the temperature adjusting step" means a temperature on a surface of the intermediate image after the start of the temperature adjusting step. Note that, in Examples of the present invention, the temperature of a region in which an intermediate image was formed was measured after the start of the temperature adjusting step using a noncontact infrared thermometer Digital Infrared Temperature Sensor FT-H20 (manufactured by KEYENCE CORPORATION).

The time over which the temperature of the intermediate image is kept at a temperature higher than or equal to the cloud points of the surfactants is preferably 0.01 seconds or longer. If the time is shorter than 0.01 seconds, the surfactants represented by the general formulae (1) and/or (2) in the ink are not sufficiently precipitated, and thus the surfactants sometimes do not sufficiently adsorb onto the surfaces of the polymer particles. The time is also preferably 100 seconds or shorter. The time is more preferably 0.1 seconds or longer and 10 seconds or shorter.

The temperature of the intermediate image can be adjusted to a temperature that is higher than or equal to the cloud points of the surfactants and lower than the minimum film-forming temperature of the polymer particles. In this case, by adjusting the heating temperature in a heating fixation step described below, the gloss of an image to be obtained can be easily controlled.

A method for adjusting the temperature of the intermediate image within the above-described particular temperature range is, for example, heating with a heater and cooling with a chiller. The case where the temperature of the intermediate image is naturally adjusted within the above-described particular temperature range is also included in the temperature adjusting step.

The temperature adjusting step is performed after the intermediate image-forming step and before a transfer step. Herein, the expression "before a transfer step" means that the temperature adjusting step may be started prior to the transfer step and the temperature adjusting step and the transfer step may overlap each other. In other words, the temperature adjusting step may be performed during the transfer step. The temperature adjustment may be performed by a method common to "a liquid-removing step" described below. That is, a liquid may be removed by a method in which the temperature of the intermediate image is adjusted within the above-described particular temperature range. In this case, such a step serves as both the temperature adjusting step and the liquid-removing step.

Liquid-Removing Step

In the first embodiment, a liquid-removing step of removing a liquid from the intermediate image formed on the intermediate transfer body may be performed after the intermediate image-forming step and before the transfer step. If an excessive amount of liquid is contained in the intermediate image, for example, such an excessive amount of liquid flows out in the transfer step, which may degrade the quality of an image to be obtained. Therefore, an excessive amount of liquid can be removed from the intermediate image by employing the liquid-removing step. Examples of a method for removing a liquid include heating, sending low-humidity air, depressurizing, air drying, and combinations of the foregoing. The temperature of the intermediate image in the liquid-removing step is not particularly limited, but can be a temperature lower than the minimum film-forming temperature of the polymer particles used in the ink.

Transfer Step

In the first embodiment, in the transfer step, the intermediate image recorded on the intermediate transfer body is brought into contact with a recording medium and thus transferred onto the recording medium from the intermediate transfer body. Consequently, an image is recorded on the recording medium.

When the intermediate image is transferred onto the recording medium, pressure can be applied from both sides of the intermediate transfer body and recording medium using, for example, a pressure roller. The application of pressure improves the transfer efficiency. Herein, the pressure may be applied through multiple stages.

As described above, with the increasing demand for high-speed recording, high transfer efficiency has been required even at a high transfer speed in recent years. Therefore, in the present invention, the transfer speed means a conveyance speed of a recording medium and is preferably 1.0 m/s or more and more preferably 2.0 m/s or more.

In the transfer, the intermediate image can be heated. The intermediate image can be heated by a method in which the pressure roller is heated to a predetermined transfer temperature or a method in which a heater is additionally disposed. The heating temperature of the pressure roller in the transfer step is preferably set in accordance with the polymer particles used and more preferably 25° C. or higher and 200° C. or lower.

In the first embodiment, the heating temperature of the pressure roller in the transfer step is preferably lower than the minimum film-forming temperature of the polymer particles used in the ink and more preferably lower than the minimum film-forming temperature of the polymer particles by 10° C. or more. Furthermore, the heating temperature is preferably higher than or equal to the cloud points of the surfactants represented by the general formulae (1) and/or (2) in the ink. This is because, if the heating temperature is lower than the cloud points, part of the surfactants that have adsorbed onto the polymer particles may be desorbed from the polymer particles.

Recording Medium

In aspects of the present invention, the recording medium includes a variety of media such as cloth, plastic, and a film, in addition to paper generally used in printing. The recording medium used in the image recording method according to an embodiment of the present invention may be cut into a desired size in advance. A rolled sheet may be used, and such a rolled sheet may be cut into a desired size after image recording.

Fixing Step

In the first embodiment, a fixing step of applying pressure, with a fixing roller, to the recording medium onto which the intermediate image has been transferred may be performed after the transfer step. The application of pressure can improves the smoothness of an image.

When pressure is applied, with a fixing roller, to the recording medium onto which an image has been transferred, the fixing roller can be heated. By using a heated fixing roller in the application of pressure, the fastness of the image can be improved. Furthermore, by adjusting the heating temperature, the gloss of the image can be controlled. Specifically, a high-gloss image is obtained by performing heating fixation at a temperature higher than or equal to the minimum film-forming temperature of the polymer particles used in the ink and a low-gloss image is obtained by performing heating fixation at a temperature lower than the minimum film-forming temperature of the polymer particles used in the ink.

Cleaning Step

In the first embodiment, a cleaning step of cleaning a surface of the intermediate transfer body may be performed after the transfer step. The intermediate transfer body can be cleaned by any publicly known method. Specific examples of the method include a method in which a cleaning liquid is sprayed onto the intermediate transfer body, a method in which a wetted damping roller is brought into contact with the intermediate transfer body to perform wiping, a method in which the intermediate transfer body is brought into contact with the surface of a cleaning liquid, a method in which residues on the intermediate transfer body are wiped off using a wiper blade, a method in which a certain energy is applied to the intermediate transfer body, and combinations of these methods.

(2) Second Embodiment

An image recording method according to a second embodiment of the present invention (hereafter may also be simply referred to as "second embodiment") includes a liquid composition-applying step of applying, to an intermediate transfer body, a liquid composition that contains a surfactant which is at least one selected from a compound represented by general formula (1) and a compound represented by general formula (2); an intermediate image-forming step of forming an intermediate image by applying an ink that contains polymer particles to the intermediate transfer body to which the liquid composition has been applied; a temperature adjusting step of adjusting a temperature of the intermediate image to a temperature higher than or equal to a cloud point of the surfactant; and a transfer step of transferring the intermediate image onto a recording medium.

The steps of the second embodiment will be described below in detail. The descriptions of the same parts as in the first embodiment are omitted.

Liquid Composition-Applying Step

In the second embodiment, a liquid composition-applying step of applying a liquid composition to an intermediate transfer body is performed prior to an intermediate image-forming step. The liquid composition can contain a reacting agent that precipitates or aggregates components (e.g., coloring material and polymer) of an ink. The method for applying a liquid composition to the intermediate transfer body and the amount of liquid composition applied are the same as those of the first embodiment.

In the second embodiment, the content of the surfactants represented by the general formulae (1) and (2) in the liquid composition is preferably 3.0% by mass or more and 70.0% by mass or less and more preferably 5.0% by mass or more and 30.0% by mass or less based on the total mass of the liquid composition. If the content is less than 5.0% by mass, the surfactants do not sufficiently adsorb onto the surfaces of the polymer particles and thus an effect of improving the transfer efficiency is sometimes not sufficiently achieved. If the content is more than 30.0% by mass, the liquid composition is unevenly applied to the intermediate transfer body due to precipitation of the surfactants represented by the general formulae (1) and (2). Consequently, white streaks or the like may be formed on an image after transfer.

Intermediate Image-Forming Step

In the second embodiment, the intermediate image-forming step is a step of applying an ink to the intermediate transfer body. The method for applying an ink to the intermediate transfer body and the intermediate transfer body are the same as those of the first embodiment.

The ink used in the image recording method according to the second embodiment contains polymer particles. The polymer particles will be described below in detail.

In the second embodiment, the content of the polymer particles in the ink is preferably 0.5% by mass or more and 40.0% by mass or less and more preferably 1.0% by mass or more and 30.0% by mass or less based on the total mass of the ink.

In the second embodiment, the mass ratio of the content of the polymer particles in the ink to the content of a coloring material can be 0.1 or more and 30.0 or less on the basis of the total mass of the ink.

Temperature Adjusting Step

In the second embodiment, the temperature adjusting step is a step of adjusting the temperature of the intermediate image to a temperature higher than or equal to the cloud points of the surfactants represented by the general formulae (1) and/or (2) in the liquid composition. The time over which and the method with which the temperature of the intermediate image is adjusted within the above-described particular temperature range are the same as those of the first embodiment.

Liquid-Removing Step

In the second embodiment, a liquid-removing step of removing a liquid from the intermediate image formed on the intermediate transfer body may be performed after the intermediate image-forming step and before the transfer step. The liquid-removing method and the temperature of the intermediate image in the liquid-removing step are the same as those of the first embodiment.

Transfer Step

In the second embodiment, in the transfer step, the intermediate image recorded on the intermediate transfer body is brought into contact with a recording medium and thus transferred onto the recording medium from the intermediate transfer body. Consequently, an image is recorded on the recording medium. The details of the transfer step and the recording medium used are the same as those of the first embodiment.

Fixing Step, and Cleaning Step

In the second embodiment, a liquid-removing step, a fixing step, and a cleaning step may also be performed as in the first embodiment. The details of these steps are the same as those of the first embodiment.

(3) Materials Used in Both First Embodiment and Second Embodiment

Surfactants Represented by General Formulae (1) and (2)

The surfactant represented by general formula (1) according to aspects of the present invention is a block copolymer including an ethylene oxide structure and a propylene oxide structure.

General formula (1)

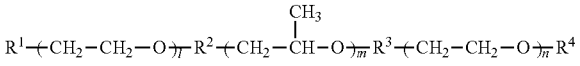

In the general formula (1), $R^1$ and $R^4$ each independently represent a hydrogen atom or an organic group. When $R^1$ and $R^4$ represent organic groups, each of the organic groups can be a hydroxyl group or a hydrocarbon group having 1 to 10 carbon atoms. When $R^1$ and $R^4$ represent hydrocarbon groups, each of the hydrocarbon groups may be linear or branched, but can be particularly linear. $R^1$ and $R^4$ preferably each independently represent a hydrogen atom, a hydroxyl group, or an alkyl group having 1 to 10 carbon atoms and more preferably each independently represent a hydrogen atom, a hydroxyl group, or a methyl group.

In the general formula (1), $R^2$ and $R^3$ each independently represent a single bond or an organic group. When $R^2$ and $R^3$ represent organic groups, each of the organic groups can be a divalent hydrocarbon group having 1 to 10 carbon atoms. When $R^2$ and $R^3$ represent hydrocarbon groups, each of the hydrocarbon groups may be linear or branched, but can be particularly linear. $R^2$ and $R^3$ preferably each independently represent a single bond or an alkylene group having 1 to 10 carbon atoms, more preferably each independently represent a single bond or a methylene group, or particularly preferably each independently represent a single bond.

In the general formula (1), l and n each independently represent 0 or more and l+n represents 2 or more and 300 or less. Furthermore, l+n preferably represents 2 or more and 80 or less and more preferably 3 or more and 27 or less.

In the general formula (1), m represents 1 or more and 70 or less. Furthermore, m preferably represents 10 or more and 60 or less and more preferably 16 or more and 31 or less.

According to aspects of the present invention, the surfactant represented by the general formula (1) can be a surfactant represented by general formula (1-A) below.

General formula (1-A)

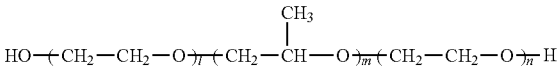

In the general formula (1-A), l+n represents 3 or more and 27 or less and m represents 16 or more and 31 or less.

The surfactant represented by general formula (2) according to aspects of the present invention is a block copolymer including an ethylene oxide structure and a propylene oxide structure.

General formula (2)

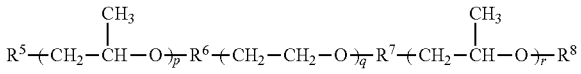

In the general formula (2), $R^5$ and $R^8$ each independently represent a hydrogen atom or an organic group. When $R^5$ and $R^8$ represent organic groups, each of the organic groups can be a hydroxyl group or a hydrocarbon group having 1 to 10 carbon atoms. When $R^5$ and $R^8$ represent hydrocarbon groups, each of the hydrocarbon groups may be linear or branched, but can be particularly linear. $R^5$ and $R^8$ preferably each independently represent a hydrogen atom, a hydroxyl group, or an alkyl group having 1 to 10 carbon atoms and more preferably each independently represent a hydrogen atom, a hydroxyl group, or a methyl group.

In the general formula (2), $R^6$ and $R^7$ each independently represent a single bond or an organic group. When $R^6$ and $R^7$ represent organic groups, each of the organic groups can be a divalent hydrocarbon group having 1 to 10 carbon atoms. When $R^6$ and $R^7$ represent hydrocarbon groups, each of the hydrocarbon groups may be linear or branched, but can be particularly linear. $R^6$ and $R^7$ preferably each independently represent a single bond or an alkylene group having 1 to 10 carbon atoms, more preferably each independently represent a single bond or a methylene group, and particularly preferably each independently represent a single bond.

In the general formula (2), p and r each independently represent 0 or more, and p+r represents 2 or more and 70 or less and preferably 2 or more and 60 or less.

In the general formula (2), q represents 1 or more and 300 or less and preferably 1 or more and 80 or less.

According to aspects of the present invention, the surfactant represented by the general formula (2) can be a surfactant represented by general formula (2-A) below.

General formula (2-A)

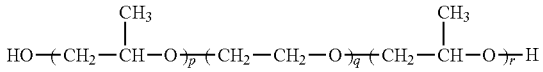

In the general formula (2-A), p+r represents 3 or more and 27 or less and q represents 16 or more and 31 or less.

The cloud points of the surfactants represented by the general formulae (1) and (2) are preferably 10° C. or higher and 100° C. or lower and more preferably 25° C. or higher and 90° C. or lower. Note that the cloud point of a surfactant is a temperature at which the phase separation between the surfactant and water occurs. According to aspects of the present invention, a temperature at which a 1 mass % aqueous surfactant solution that is being gradually heated becomes cloudy is defined as the cloud point of the surfactant.

Polymer Particles

In the present invention, the term "polymer particles" refers to a polymer that is dispersed in a solvent while having a particle diameter. In the present invention, a 50% cumulative volume mean diameter ($D_{50}$) of the polymer particles is preferably 10 nm or more and 1000 nm or less and more preferably 50 nm or more and 500 nm or less. In the present invention, $D_{50}$ of the polymer particles is measured by the following process: a polymer particle dispersion is diluted 50 fold (volume basis) with pure water and measurement is conducted using UPA-EX150 (manufactured by Nikkiso Co., Ltd.) under conditions of SetZero: 30 s, number of runs: 3, measurement time: 180 seconds, and refractive index: 1.5.

The polystyrene-equivalent weight-average molecular weight of the polymer particles determined by gel permeation chromatography (GPC) can be 1,000 or more and 2,000,000 or less.

The minimum film-forming temperature of the polymer particles can be 20° C. or higher and 100° C. or lower. The method for measuring the minimum film-forming temperature of the polymer particles in the present invention is in conformity with "Determination of minimum film-forming temperature" in JIS K 6828-2.

According to aspects of the present invention, any polymer particles can be used for the ink as long as the above-described definition of polymer particles is satisfied. Any monomer can be used for the polymer particles as long as the monomer can be polymerized by emulsion polymerization, suspension polymerization, or dispersion polymerization. Examples of the polymer particles composed of different monomers include acrylic polymer particles, vinyl acetate-based polymer particles, ester-based polymer particles, ethylene-based polymer particles, urethane-based polymer particles, synthetic rubber-based polymer particles, vinyl chloride-based polymer particles, vinylidene chloride-based polymer particles, and olefin-based polymer particles. In particular, acrylic polymer particles and urethane polymer particles can be used.

Specific examples of monomers that can be used for the acrylic polymer particles include α,β-unsaturated carboxylic acids such as (meth)acrylic acid, maleic acid, crotonic acid, angelic acid, itaconic acid, and fumaric acid; salts of the α,β-unsaturated carboxylic acids; α,β-unsaturated carboxylic acid ester compounds such as ethyl(meth)acrylate, methyl (meth)acrylate, butyl(meth)acrylate, methoxyethyl(meth) acrylate, ethoxyethyl(meth)acrylate, diethylene glycol(meth) acrylate, triethylene glycol(meth)acrylate, tetraethylene glycol(meth)acrylate, polyethylene glycol(meth)acrylate, methoxydiethylene glycol(meth)acrylate, methoxytriethylene glycol(meth)acrylate, methoxytetraethylene glycol (meth)acrylate, methoxypolyethylene glycol(meth)acrylate, cyclohexyl(meth)acrylate, isobornyl(meth)acrylate, N,N-dimethylaminopropyl(meth)acrylate, monobutyl maleate, and dimethyl itaconate; α,β-unsaturated carboxylic acid alkylamide compounds such as (meth)acrylamide, dimethyl (meth)acrylamide, N,N-dimethylethyl(meth)acrylamide, N,N-dimethylpropyl(meth)acrylamide, isopropyl(meth) acrylamide, diethyl(meth)acrylamide, (meth)acryloyl morpholine, maleic acid monoamide, and crotonic acid methylamide; α,β-ethylenically unsaturated compounds having an aryl group, such as styrene, α-methylstyrene, vinyl phenyl acetate, benzyl(meth)acrylate, and 2-phenoxyethyl(meth) acrylate; and polyfunctional alcohol ester compounds such as ethylene glycol diacrylate and polypropylene glycol dimethacrylate. A single monomer may be polymerized to form a homopolymer or two or more types of monomers may be polymerized to form a copolymer. When the polymer particles are composed of a copolymer, the copolymer may be a random copolymer or a block copolymer. In particular, the polymer particles can be composed of a hydrophilic monomer and a hydrophobic monomer. Examples of the hydrophilic monomer include α,β-unsaturated carboxylic acids and salts thereof. Examples of the hydrophobic monomer include α,β-unsaturated carboxylic acid ester compounds and α,β-ethylenically unsaturated compounds having an aryl group.

The urethane polymer particles are polymer particles synthesized by causing a reaction between a polyisocyanate compound, which is a compound having two or more isocyanate groups, and a polyol compound, which is a compound having two or more hydroxyl groups. In aspects of the present invention, any urethane polymer particles synthesized by causing a reaction between a publicly known polyisocyanate compound and a publicly known polyol compound can be used as long as the above-described conditions of the polymer particles are satisfied.

The polymer particles are classified into polymer particles having a single-layer structure and polymer particles having a multilayer structure such as a core-shell structure. According to aspects of the present invention, polymer particles having a multilayer structure can be used and polymer particles having a core-shell structure can be particularly used. When the polymer particles have a core-shell structure, the function is clearly divided between a core portion and a shell portion. Such polymer particles having a core-shell structure have an advantage in that many functions can be imparted to an ink compared with polymer particles having a single-layer structure.

Coloring Material

According to aspects of the present invention, the ink may further contain a coloring material. Examples of the coloring material include pigments and dyes. Any publicly known pigments and dyes can be used. In aspects of the present invention, a pigment can be used from the viewpoint of water resistance of an image. The content of the coloring material is preferably 0.5% by mass or more and 15.0% by mass or less and more preferably 1.0% by mass or more and 10.0% by mass or less based on the total mass of the ink.

In the case where a pigment is used as a coloring material in aspects of the present invention, examples of the types of pigments that can be used in the form of dispersion include polymer dispersion type pigments that use polymers as dispersants (polymer-dispersion pigments that use polymer dispersants, microcapsule pigments constituted by pigment particles having polymer-coated surfaces, and polymer-bonded pigments in which organic groups that contain polymers are chemically bonded to surfaces of pigment particles) and self-dispersion type pigments in which hydrophilic groups are introduced to surfaces of pigment particles. Naturally, pigments with different dispersion forms can be used in combination. In particular, carbon black and organic pigments can be used as the pigments. The pigments can be used alone or in combination of two or more. When the pigment used in the ink is a polymer dispersion type pigment, a polymer is used as a dispersant. The polymer used as the dispersant can have a hydrophilic moiety and a hydrophobic moiety. Specific examples of such a polymer include acrylic polymers prepared by polymerizing carboxyl group-containing monomers such as acrylic acid and methacrylic acid; and urethane polymers prepared by polymerizing diols having anionic groups, such as dimethylolpropionic acid. The acid value of the polymer used as the dispersant can be 50 mgKOH/g or more and 550 mgKOH/g or less. The polystyrene-equivalent weight-average molecular weight (Mw) of the polymer used as the dispersant according to GPC can be 1,000 or more and 50,000 or less. The content of the polymer dispersant in the ink is 0.1% by mass or more and 10.0% by mass or less and preferably 0.2% by mass or more and 4.0% by mass or less based on the total mass of the ink. The mass ratio of the content of the polymer dispersant to the content of the pigment can be 0.1 or more and 3.0 or less.

Reacting Agent

According to aspects of the present invention, the liquid composition may contain a reacting agent that precipitates or aggregates components (e.g., coloring material and polymer) of the ink. A publicly known compound can be used as the reacting agent. In particular, at least one selected from polyvalent metal ions and organic acids can be used. The liquid composition can contain multiple types of reacting agents.

Specific examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$. In aspects of the present invention, the polyvalent metal ions can be added to the liquid composition in the form of salts such as a hydroxide and a chloride and may be used as dissociated ions. In aspects of the present invention, the content of the polyvalent metal ions can be 3% by mass or more and 90% by mass or less based on the total mass of the liquid composition.

Specific examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, oxysuccinic acid, and dioxysuccinic acid. According to aspects of the present invention, the content of the organic acid can be 3% by mass or more and 99% by mass or less based on the total mass of the liquid composition.

Aqueous Medium

The ink and liquid composition according to an embodiment of the present invention may contain an aqueous medium such as water or a mixed solvent of water and a water-soluble organic solvent. The content of the water-soluble organic solvent can be 3.0% by mass or more and 50.0% by mass or less based on the total mass of the ink or liquid composition. Any commonly used water-soluble organic solvent can be used as the water-soluble organic solvent. Examples of the water-soluble organic solvent include alcohols, glycols, alkylene glycols having an alkylene group with 2 to 6 carbon atoms, polyethylene glycols, nitrogen-containing compounds, and sulfur-containing compounds. These water-soluble organic solvents may be optionally used alone or in combination of two or more. Deionized water (ion exchanged water) can be used as the water. The content of the water can be 50.0% by mass or more and 95.0% by mass or less based on the total mass of the ink or liquid composition.

Other Components

In addition to the above components, the ink and liquid composition according to an embodiment of the present invention may optionally contain polyhydric alcohols such as trimethylolpropane and trimethylolethane, urea derivatives such as urea and ethyleneurea, and water-soluble organic compounds which are solid at normal temperature. The ink and liquid composition according to an embodiment of the present invention may optionally further contain various additives such as a surfactant, a pH adjuster, an anticorrosive, a preservative, a fungicide, an antioxidant, a reducing inhibitor, an evaporation promoter, a chelating agent, and a polymer.

In particular, the liquid composition according to an embodiment of the present invention can contain polymer particles such as acrylic polymer particles, urethane polymer particles, and polyolefin polymer particles; inorganic particles such as silica particles, titania particles, alumina particles, and zirconia particles; and silicone oil and fluorocarbon oil from the viewpoint of imparting strength and a slipping property to an image to be obtained and thus improving the abrasion resistance. The content of the particles can be 1% by mass or more and 30% by mass or less based on the total mass of the liquid composition.

EXAMPLES

Aspects of the present invention will now be further described in detail based on Examples and Comparative Examples. Examples below do not limit the scope of the present invention. In Examples below, "part" means "part by mass" unless otherwise specified.

Preparation of Ink

Preparation of Pigment Dispersion

Ten parts of carbon black (trade name: MONARCH 1100, manufactured by Cabot Corporation), 15 parts of an aqueous polymer solution (styrene-ethyl acrylate-acrylic acid copolymer, manufactured by neutralizing an aqueous polymer solution having an acid value of 150, a weight-average molecular weight of 8000, and a polymer content of 20.0% by mass with an aqueous potassium hydroxide solution), and 75 parts of pure water were mixed with each other. The mixture was charged into a batch-type vertical sand mill (manufactured by AIMEX Co. Ltd.), 200 parts of zirconia beads having a diameter of 0.3 mm were filled therein, and the resulting mixture was dispersed for 5 hours under water cooling. The resulting dispersion liquid was centrifuged to remove coarse particles. As a result, a pigment dispersion having a pigment content of 10.0% by mass was obtained.

Preparation of Polymer Particle Dispersion

Preparation of Polymer Particle Dispersion 1

18 parts of ethyl methacrylate, 2 parts of 2,2'-azobis-(2-methylbutyronitrile), and 2 parts of n-hexadecane were mixed and stirred for 0.5 hours. The resulting mixture was added dropwise to 78 parts of a 6% aqueous solution of NIKKOL BC20 (manufactured by Nikko Chemicals Co., Ltd.) serving as an emulsifier, followed by stirring for 0.5 hours. Then, the resulting mixture was irradiated with ultrasonic waves for 3 hours using an ultrasonic irradiator. Then, a polymerization reaction was carried out in a nitrogen atmosphere at 85° C. for 3 hours and the resulting reaction product was cooled to room temperature and filtered to prepare a polymer particle dispersion 1 having a polymer content of 20.0% by mass. The minimum film-forming temperature was 100° C.

Preparation of Polymer Particle Dispersion 2

A polymer particle dispersion 2 having a polymer content of 20.0% by mass was prepared by using Hitec S-3121 (manufactured by TORO CHEMICAL INDUSTRY Co., Ltd., minimum film-forming temperature: 77° C.)

Preparation of Surfactants

Surfactants listed in Tables 1 and 2 were prepared. These surfactants are manufactured by ADEKA Corporation.

TABLE 1

Surfactants represented by general formula (1)

General formula (1-A)

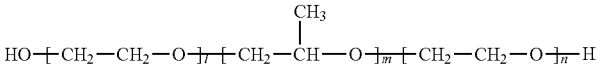

| Surfactant No. | Product name | Ethylene oxide structure l + n | Propylene oxide structure m | Cloud point (° C.) |
|---|---|---|---|---|
| Surfactant 1-1 | Pluronic L31 | 3.0 | 16.4 | 39 |
| Surfactant 1-2 | Pluronic L44 | 22.3 | 20.7 | 70 |
| Surfactant 1-3 | Pluronic L34 | 14.0 | 16.4 | 54 |
| Surfactant 1-4 | Pluronic L61 | 5.3 | 30.2 | 24 |
| Surfactant 1-5 | Pluronic P84 | 43.9 | 38.8 | 60 |
| Surfactant 1-6 | Pluronic P103 | 37.1 | 56.0 | 67 |
| Surfactant 1-7 | Pluronic L101 | 12.1 | 56.0 | 15 |
| Surfactant 1-8 | Pluronic P85 | 53.0 | 38.8 | 75 |
| Surfactant 1-9 | Pluronic P123 | 40.5 | 66.4 | 90 |

TABLE 2

Surfactants represented by general formula (2)

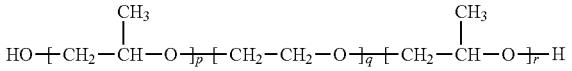

| Surfactant No. | Product name | Ethylene oxide structure q | Propylene oxide structure p + r | Cloud point (° C.) |
|---|---|---|---|---|
| Surfactant 2-1 | Pluronic 17R-4 | 25.7 | 30.2 | 44 |
| Surfactant 2-2 | Pluronic 25R-2 | 16.6 | 47.4 | 29 |
| Surfactant 2-3 | Pluronic 17R-2 | 16.6 | 30.2 | 33 |

Preparation of Ink

The prepared polymer particle dispersion and pigment dispersion were mixed with components listed below. The balance of ion exchanged water is an amount added so as to adjust the total content of all components constituting an ink to 100.0% by mass.

Pigment dispersion (content of coloring material: 10.0% by mass): 20.0% by mass

Polymer particle dispersion (content of polymer: 20.0% by mass): X % by mass in Table 3

Diethylene glycol: 10.0% by mass

Acetylenol E100 (surfactant manufactured by Kawaken Fine Chemicals Co., Ltd.): 0.5% by mass Surfactant: Y % by mass in Table 3

Ion exchanged water: balance

The resulting mixture was thoroughly stirred and dispersed, and then filtered under pressure using a microfilter (manufactured by FUJIFILM Corporation) having a pore size of 3.0 μm to prepare an ink.

TABLE 3

Ink preparation conditions

| | Polymer particle dispersion | | | Surfactant | | Polymer |
|---|---|---|---|---|---|---|
| Ink No. | Polymer particle dispersion No. | MFT (° C.) | Content X (mass %) | Surfactant No. | Content Y (mass %) | particles/ surfactant |
| Ink 1 | Polymer particle dispersion 1 | 100 | 50.0 | Surfactant 1-1 | 3.0 | 3.33 |
| Ink 2 | Polymer particle dispersion 1 | 100 | 50.0 | Surfactant 1-2 | 3.0 | 3.33 |
| Ink 3 | Polymer particle dispersion 1 | 100 | 50.0 | Surfactant 2-1 | 3.0 | 3.33 |
| Ink 4 | Polymer particle dispersion 1 | 100 | 50.0 | Surfactant 1-3 | 3.0 | 3.33 |
| Ink 5 | Polymer particle dispersion 1 | 100 | 50.0 | Surfactant 1-4 | 3.0 | 3.33 |
| Ink 6 | Polymer particle dispersion 1 | 100 | 50.0 | Surfactant 1-5 | 3.0 | 3.33 |
| Ink 7 | Polymer particle dispersion 1 | 100 | 50.0 | Surfactant 1-6 | 3.0 | 3.33 |
| Ink 8 | Polymer particle dispersion 1 | 100 | 50.0 | Surfactant 1-7 | 3.0 | 3.33 |
| Ink 9 | Polymer particle dispersion 1 | 100 | 50.0 | Surfactant 2-2 | 3.0 | 3.33 |
| Ink 10 | Polymer particle dispersion 1 | 100 | 50.0 | Surfactant 2-3 | 3.0 | 3.33 |
| Ink 11 | Polymer particle dispersion 1 | 100 | 50.0 | Surfactant 1-8 | 3.0 | 3.33 |
| Ink 12 | Polymer particle dispersion 1 | 100 | 50.0 | Surfactant 1-9 | 3.0 | 3.33 |
| Ink 13 | Polymer particle dispersion 1 | 100 | 50.0 | Surfactant 1-1 | 0.5 | 20.00 |
| Ink 14 | Polymer particle dispersion 1 | 100 | 50.0 | Surfactant 1-1 | 0.1 | 100.00 |
| Ink 15 | Polymer particle dispersion 1 | 100 | 50.0 | Surfactant 1-1 | 10.0 | 1.00 |
| Ink 16 | Polymer particle dispersion 1 | 100 | 50.0 | Surfactant 1-1 | 10.5 | 0.95 |
| Ink 17 | Polymer particle dispersion 1 | 100 | 5.0 | Surfactant 1-1 | 3.0 | 0.33 |
| Ink 18 | Polymer particle dispersion 1 | 100 | 2.5 | Surfactant 1-1 | 3.0 | 0.17 |
| Ink 19 | Polymer particle dispersion 1 | 100 | 50.0 | — | 0 | — |
| Ink 20 | Polymer particle dispersion 1 | 100 | 0 | Surfactant 1-1 | 3.0 | 0 |
| Ink 21 | Polymer particle dispersion 2 | 70 | 50.0 | Surfactant 1-1 | 3.0 | 3.33 |

Preparation of Liquid Composition

Components listed below were mixed with each other, and the mixture was thoroughly stirred and dispersed and then filtered under pressure using a microfilter (manufactured by FUJIFILM Corporation) having a pore size of 3.0 μm to prepare a liquid composition. The balance of ion exchanged water is an amount added so as to adjust the total content of all components constituting an ink to 100.0% by mass.

Levulinic acid: 45.0% by mass

Potassium hydroxide (neutralizing agent): 3.0% by mass

AQUACER 531 (modified polyethylene wax dispersion, manufactured by BYK Japan KK): 15.0% by mass Megaface F444 (perfluoroalkylethylene oxide adduct, manufactured by DIC Corporation): 3.0% by mass Surfactant: Z % by mass in Table 4

Ion exchanged water: balance

TABLE 4

Liquid composition preparation conditions

| | Surfactant | |
|---|---|---|
| Liquid composition No. | Surfactant No. | Content Z (mass %) |
| Liquid composition 1 | Surfactant 1-1 | 30 |
| Liquid composition 2 | Surfactant 1-2 | 30 |
| Liquid composition 3 | Surfactant 2-1 | 30 |
| Liquid composition 4 | Surfactant 1-1 | 5 |
| Liquid composition 5 | Surfactant 1-1 | 3 |
| Liquid composition 6 | — | 0 |
| Liquid composition 7 | Surfactant 1-1 | 34 |

Production of Intermediate Transfer Body

A cylindrical drum composed of an aluminum alloy was used as a supporting member of an intermediate transfer body. A siloxane compound surface layer made of a hydrolyzable organic silicon compound was then disposed on a surface of the supporting member by the following method. First, glycidoxypropyltriethoxysilane and methyltriethoxysilane were mixed at a molar ratio of 1:1. The mixture was subjected to heat reflux in a water medium for over 24 hours using hydrochloric acid as a catalyst to obtain a hydrolyzable condensate solution. Subsequently, the hydrolyzable condensate solution was diluted with methyl isobutyl ketone to 10% to 20% by mass, and a photocationic polymerization initiator SP150 (manufactured by ADEKA Corporation) was added in an amount of 5% by mass based on the solid content to obtain a coating solution. The coating solution was applied by spin coating onto a surface of the supporting member subjected to a plasma treatment. Furthermore, the surface was exposed using a UV lamp and heated at 130° C. for three hours. As a result, an intermediate transfer body was produced. The thickness of the surface layer of the produced intermediate transfer body was about 0.3 μm.

Evaluation

Evaluation of Transfer Efficiency

Each of ink cartridges was filled with the above ink and liquid composition with a combination listed in Table 5 and then mounted on an image recording apparatus illustrated in FIGURE. First, the liquid composition was applied onto an intermediate transfer body using an application roller in an amount of 0.8 g/m$^2$. The ink was ejected from an inkjet recording head to the intermediate transfer body onto which the liquid composition was applied to record an intermediate image with a recording duty of 100% (solid image with a size of 1 cm×1 cm). In the image recording apparatus, conditions for applying a single ink droplet with 4 pl to a unit region with a size of 1/1200 inch×1/1200 inch at a resolution of 1200 dpi×1200 dpi are defined to be a recording duty of 100%. Subsequently, the temperature of the intermediate image was adjusted to a temperature (temperature $T_1$ of an intermediate image in a temperature adjusting step) shown in Table 5 with a heating mechanism and the temperature was held for at least one second. Furthermore, air at 25° C. was sent to the intermediate image for 60 seconds using a liquid removing unit. Subsequently, the intermediate image was transferred onto a recording medium, Aurora Coat (manufactured by Nippon Paper Industries Co., Ltd.), at a transfer speed of 2.0 m/s using a pressure roller heated to a predetermined temperature (transfer temperature $T_2$) listed in Table 5. After a series of these steps were repeatedly performed 25 times, the proportion of the intermediate image remaining on a surface of the intermediate transfer body, that is, the transfer residual ratio (%) was calculated. Specifically, the transfer residual ratio was determined in such a manner that the intermediate transfer body was disengaged from the supporting member, the surface of the intermediate transfer body was captured as an image, and the percentage of the area of the intermediate image remaining on the intermediate transfer body without being transferred in the area where the intermediate image was recorded was calculated. The transfer efficiency was evaluated from the transfer residual ratio. The evaluation criteria are shown below. In aspects of the present invention, in the evaluation criteria, A to C were allowable levels and D was an unallowable level. Table 5 shows the evaluation results.

A: The transfer residual ratio was less than 3%, and the transfer efficiency was very high.

B: The transfer residual ratio was 3% or more and less than 7%, and the transfer efficiency was high.

C: The transfer residual ratio was 7% or more and less than 15%, and the transfer efficiency was relatively high.

D: The transfer residual ratio was 15% or more, and the transfer efficiency was low.

Evaluation of Ink Ejection Stability

Among the above inks, the inks 1 and 15 to 18, which had different contents of the at least one surfactant selected from the compound represented by the general formula (1) and the compound represented by the general formula (2), were evaluated in terms of ejection stability by the following method.

An ink cartridge was filled with each of the inks 1 and 15 to 18 and mounted on an inkjet printer including the same recording head as the image recording apparatus of FIGURE. Ruled lines were then continuously printed on 100 PPC sheets made by CANON KABUSHIKI KAISHA, and the thickness and position errors of the ruled lines were visually evaluated. The evaluation criteria are shown below. Table 5 shows the results.

A: Almost no change in the thickness of the ruled lines was made and almost no position errors were observed.

B: The thickness of the ruled lines decreased, but almost no position errors were observed.

C: The thickness of the ruled lines decreased and the position errors were also observed.

TABLE 5

Combination of ink and liquid composition and Evaluation results

| Example No. | Ink No. | Liquid composition No. | Cloud point of surfactant in ink and/or liquid composition (° C.) Ink | Liquid composition | MFT (° C.) of polymer particles in ink | Temperature $T_1$ (° C.) of intermediate image in temperature adjusting step | Transfer temperature $T_2$ (° C.) | Evaluation result Transfer efficiency | Ink ejection stability |
|---|---|---|---|---|---|---|---|---|---|
| Example 1 | Ink 1 | Liquid composition 1 | 39 | 39 | 100 | 50 | 30 | A | A |
| Example 2 | Ink 1 | Liquid composition 6 | 39 | — | 100 | 50 | 30 | A | — |
| Example 3 | Ink 2 | Liquid composition 6 | 70 | — | 100 | 80 | 30 | A | — |
| Example 4 | Ink 3 | Liquid composition 6 | 44 | — | 100 | 50 | 30 | A | — |
| Example 5 | Ink 4 | Liquid composition 6 | 54 | — | 100 | 80 | 30 | A | — |
| Example 6 | Ink 5 | Liquid composition 6 | 24 | — | 100 | 50 | 30 | A | — |
| Example 7 | Ink 6 | Liquid composition 6 | 60 | — | 100 | 80 | 30 | C | — |
| Example 8 | Ink 7 | Liquid composition 6 | 67 | — | 100 | 50 | 30 | C | — |
| Example 9 | Ink 8 | Liquid composition 6 | 15 | — | 100 | 50 | 30 | B | — |
| Example 10 | Ink 9 | Liquid composition 6 | 29 | — | 100 | 50 | 30 | B | — |
| Example 11 | Ink 10 | Liquid composition 6 | 33 | — | 100 | 50 | 30 | A | — |
| Example 12 | Ink 11 | Liquid composition 6 | 75 | — | 100 | 80 | 30 | C | — |
| Example 13 | Ink 12 | Liquid composition 6 | 90 | — | 100 | 99 | 30 | C | — |
| Example 16 | Ink 13 | Liquid composition 6 | 39 | — | 100 | 50 | 30 | A | A |
| Example 17 | Ink 14 | Liquid composition 6 | 39 | — | 100 | 50 | 30 | B | A |
| Example 18 | Ink 15 | Liquid composition 6 | 39 | — | 100 | 50 | 30 | A | A |
| Example 19 | Ink 16 | Liquid composition 6 | 39 | — | 100 | 50 | 30 | A | B |
| Example 20 | Ink 17 | Liquid composition 6 | 39 | — | 100 | 50 | 30 | A | — |
| Example 21 | Ink 18 | Liquid composition 6 | 39 | — | 100 | 50 | 30 | B | — |
| Example 22 | Ink 21 | Liquid composition 1 | 39 | 39 | 77 | 80 | 30 | A | — |
| Example 23 | Ink 1 | Liquid composition 1 | 39 | 39 | 100 | 50 | 50 | A | — |
| Example 24 | Ink 1 | Liquid composition 1 | 39 | 39 | 100 | 50 | 80 | A | — |
| Example 25 | Ink 19 | Liquid composition 1 | — | 39 | 100 | 50 | 30 | A | — |
| Example 26 | Ink 19 | Liquid composition 2 | — | 70 | 100 | 80 | 30 | A | — |
| Example 27 | Ink 19 | Liquid composition 3 | — | 44 | 100 | 50 | 30 | A | — |
| Example 28 | Ink 19 | Liquid composition 4 | — | 39 | 100 | 50 | 30 | A | — |
| Example 29 | Ink 19 | Liquid composition 5 | — | 39 | 100 | 50 | 30 | B | — |
| Example 30 | Ink 19 | Liquid composition 7 | — | 39 | 100 | 50 | 30 | B | — |
| Comparative Example 1 | Ink 19 | Liquid composition 6 | — | — | 100 | 50 | 30 | D | — |
| Comparative Example 2 | Ink 20 | Liquid composition 6 | 39 | — | — | 50 | 30 | D | — |
| Comparative Example 3 | Ink 1 | Liquid composition 1 | 39 | 39 | 100 | 30 | 30 | D | — |
| Comparative Example 4 | Ink 2 | Liquid composition 2 | 70 | 70 | 100 | 60 | 30 | D | — |
| Comparative Example 5 | Ink 3 | Liquid composition 3 | 44 | 44 | 100 | 30 | 30 | D | — |

According to aspects of the present invention, an image recording method with high transfer efficiency can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-125709, filed Jun. 14, 2013, which is hereby incorporated by reference herein in its entirety.

What is claimed is:

1. An image recording method comprising:

an intermediate image-forming step of forming an intermediate image by applying an ink to an intermediate transfer body;

a temperature adjusting step; and a transfer step of transferring the intermediate image onto a recording medium, in this order, wherein the ink comprises polymer particles and a surfactant which is at least one selected from a compound represented by general formula (1) below and a compound represented by general formula (2) below, and in the temperature adjusting step, a temperature of the intermediate image is adjusted to a temperature higher than or equal to a cloud point of the surfactant, General formula (1)

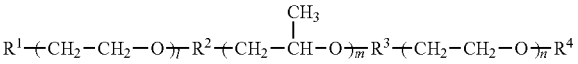

where $R^1$ and $R^4$ each independently represent a hydrogen atom or an organic group, $R^2$ and $R^3$ each independently represent a single bond or an organic group, l and n each independently represent 0 or more, l+n represents 2 or more and 300 or less, and m represents 1 or more and 70 or less, and General formula (2)

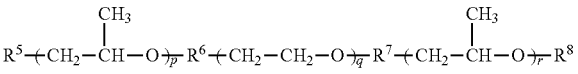

where $R^5$ and $R^8$ each independently represent a hydrogen atom or an organic group, $R^6$ and $R^7$ each independently represent a single bond or an organic group, p and r each independently represent 0 or more, p+r represents 2 or more and 70 or less, and q represents 1 or more and 300 or less.

2. The image recording method according to claim 1, wherein in the temperature adjusting step, the temperature of the intermediate image is adjusted to a temperature that is higher than or equal to a cloud point of the surfactant and lower than a minimum film-forming temperature of the polymer particles.

3. The image recording method according to claim 1, further comprising, before the intermediate image-forming step:

a liquid composition-applying step of applying a liquid composition containing a reacting agent to the intermediate transfer body.

4. The image recording method according to claim 1, wherein a content of the surfactant in the ink is 0.5% by mass or more and 10.0% by mass or less based on the total mass of the ink.

5. The image recording method according to claim 1, wherein a content of the polymer particles in the ink is 1.0% by mass or more and 30.0% by mass or less based on the total mass of the ink.

6. The image recording method according to claim 1, wherein a mass ratio of a content of the polymer particles to a content of the surfactant is 0.33 or more and 20 or less based on the total mass of the ink.

7. The image recording method according to claim 1, wherein a temperature of a pressure roller used in the transfer step is lower than a minimum film-forming temperature of the polymer particles.

8. The image recording method according to claim 7, wherein the temperature of the pressure roller is lower than the minimum film-forming temperature of the polymer particles by 10° C. or more.

9. The image recording method according to claim 1, further comprising, after the transfer step:

a fixing step of applying a pressure, with a fixing roller, to the recording medium onto which the intermediate image has been transferred.

10. An image recording method comprising:

a liquid composition-applying step of applying a liquid composition containing a surfactant to an intermediate transfer body;

an intermediate image-forming step of forming an intermediate image by applying an ink containing polymer particles to the intermediate transfer body to which the liquid composition has been applied;

a temperature adjusting step; and a transfer step of transferring the intermediate image onto a recording medium, in this order, wherein the surfactant is at least one selected from a compound represented by general formula (1) below and a compound represented by general formula (2) below, and in the temperature adjusting step, a temperature of the intermediate image is adjusted to a temperature higher than or equal to a cloud point of the surfactant, General formula (1)

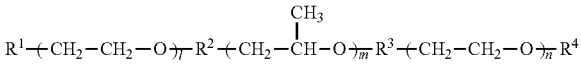

where $R^1$ and $R^4$ each independently represent a hydrogen atom or an organic group, $R^2$ and $R^3$ each independently represent a single bond or an organic group, l and n each independently represent 0 or more, l+n represents 2 or more and 300 or less, and m represents 1 or more and 70 or less, and General formula (2)

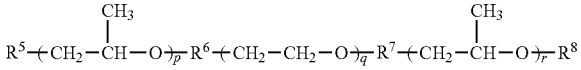

where $R^5$ and $R^8$ each independently represent a hydrogen atom or an organic group, $R^6$ and $R^7$ each independently represent a single bond or an organic group, p and r each independently represent 0 or more, p+r represents 2 or more and 70 or less, and q represents 1 or more and 300 or less.

11. The image recording method according to claim 10, wherein in the temperature adjusting step, the temperature of the intermediate image is adjusted to a temperature that is higher than or equal to a cloud point of the surfactant and lower than a minimum film-forming temperature of the polymer particles.

12. The image recording method according to claim 10, wherein the liquid composition comprises a reacting agent.

13. The image recording method according to claim 10, wherein a content of the surfactant in the liquid composition is 5.0% by mass or more and 30.0% by mass or less based on the total mass of the liquid composition.

14. The image recording method according to claim 10, wherein a content of the polymer particles in the ink is 1.0% by mass or more and 30.0% by mass or less based on the total mass of the ink.

15. The image recording method according to claim 10, wherein a temperature of a pressure roller used in the transfer step is lower than a minimum film-forming temperature of the polymer particles.

16. The image recording method according to claim 15, wherein the temperature of the pressure roller is lower than the minimum film-forming temperature of the polymer particles by 10° C. or more.

17. The image recording method according to claim 10, further comprising, after the transfer step:

a fixing step of applying a pressure, with a fixing roller, to the recording medium onto which the intermediate image has been transferred.

* * * * *